United States Patent [19]

King

[11] 4,303,033

[45] Dec. 1, 1981

[54] PORTABLE PONTOON BOAT

[76] Inventor: Gary D. King, Rte. #1, Box 192A, Mound Valley, Kans. 67354

[21] Appl. No.: 99,212

[22] Filed: Nov. 30, 1979

[51] Int. Cl.[3] ..... B63B 7/04

[52] U.S. Cl. ..... 114/61; 9/2 S; 440/6

[58] Field of Search ..... 9/2 R, 2 C, 2 S; 114/61, 77 R, 283, 292; 440/6

[56] References Cited

U.S. PATENT DOCUMENTS

| | | | |
|---|---|---|---|
| 2,588,084 | 3/1952 | Bushfield | 9/2 R X |
| 2,916,748 | 12/1959 | Stammer | 9/2 S |
| 3,179,960 | 4/1965 | Nimmo | 9/2 S |
| 3,193,851 | 7/1965 | Fiebelkorn | 114/61 X |
| 3,426,716 | 2/1969 | Hackworth | 114/61 |
| 3,614,937 | 10/1971 | Schulman | 114/283 |
| 3,968,532 | 7/1976 | Bailey | 9/2 C |

*Primary Examiner*—Jeffrey V. Nase
*Attorney, Agent, or Firm*—Harvey B. Jacobson

[57] ABSTRACT

Pontoons are formed from elongated bodies of flotation material enclosed in rigid, channel-shaped housings and assembled in spaced relationship to each other by assembly rods extending through the pontoons and a platform member intermediate the pontoons. A seat is mounted on the platform member for angular displacement about a vertical axis.

8 Claims, 4 Drawing Figures

PORTABLE PONTOON BOAT

BACKGROUND OF THE INVENTION

This invention relates to small and portable fishing boats of the pontoon type.

A knock-down pontoon boat is already disclosed in U.S. Pat. No. 2,916,748 to Stahmer. The pontoon components of the boat are made of tubular members according to the Stahmer patent. The tubular members are interconnected by a plurality of longitudinally spaced cross frame members. An outboard motor may be attached by means of a bracket to an end frame member. In order to construct a pontoon boat that is substantially light weight, the use of elongated foam-type flotation bodies with protective bottom coverings is disclosed in the U.S. Pat. No. 3,115,860 to Payne. Other pontoon boat structures of which applicant is presently aware, are disclosed in U.S. Pat. Nos. 3,026,841, 3,614,937 and 3,787,910. The use of light weight flotation material in a pontoon boat construction according to the foregoing prior art patents is, however, often inconsistent with the design of a knock-down type of construction which will provide adequate occupant support and strength during use.

It is, therefore, an important object of the present invention to provide pontoon type fishing boats capable of being assembled from relatively small light weight and portable components having the requisite strength and rigidity when assembled.

SUMMARY OF THE INVENTION

In accordance with the present invention, a pair of pontoons are formed by elongated flotation bodies enclosed by channel-shaped, aluminum housings spaced from each other by a aluminum platform member having depending side flanges abutting the housings of the pontoons intermediate the longitudinal ends of the pontoons. At least two assembly rods extend through the pontoons and the side flanges of the platform member closely spaced below the top surfaces of the pontoons and the platform member which are thereby maintained in flush or coplanar relation to each other. Cotter pins insertable through apertures adjacent opposite ends of the assembly rods hold the pontoons and platform member assembled. When disassembled, the foregoing components of the pontoon boat may be readily carried and stored in the trunk of an automobile. A seat assembly rotatable by 360° about a vertical axis is adapted to be mounted on the platform member while a propelling and steering assembly may be optionally secured by means of a bracket to the platform member between the pontoons. Alternatively, the pontoon boat may be propelled by means of an oar. In order to increase flotation of the boat, a body of flotation material may be secured to the underside of the platform member. The flotation bodies of the boat will provide the requisite flotation as well as to enable construction of the components in a light weight fashion.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF PREFERRED EMBODIMENT

Figure 1:
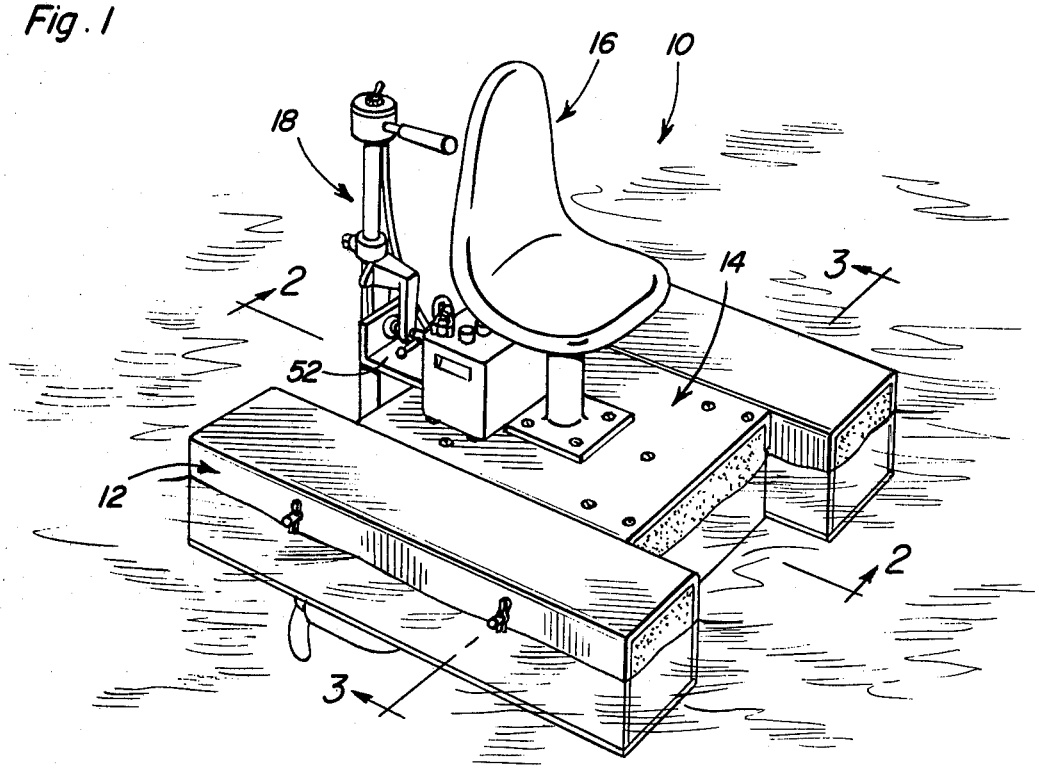
FIG. 1 is a perspective view illustrating a pontoon boat construction, in accordance with the present invention.
Figure 4:
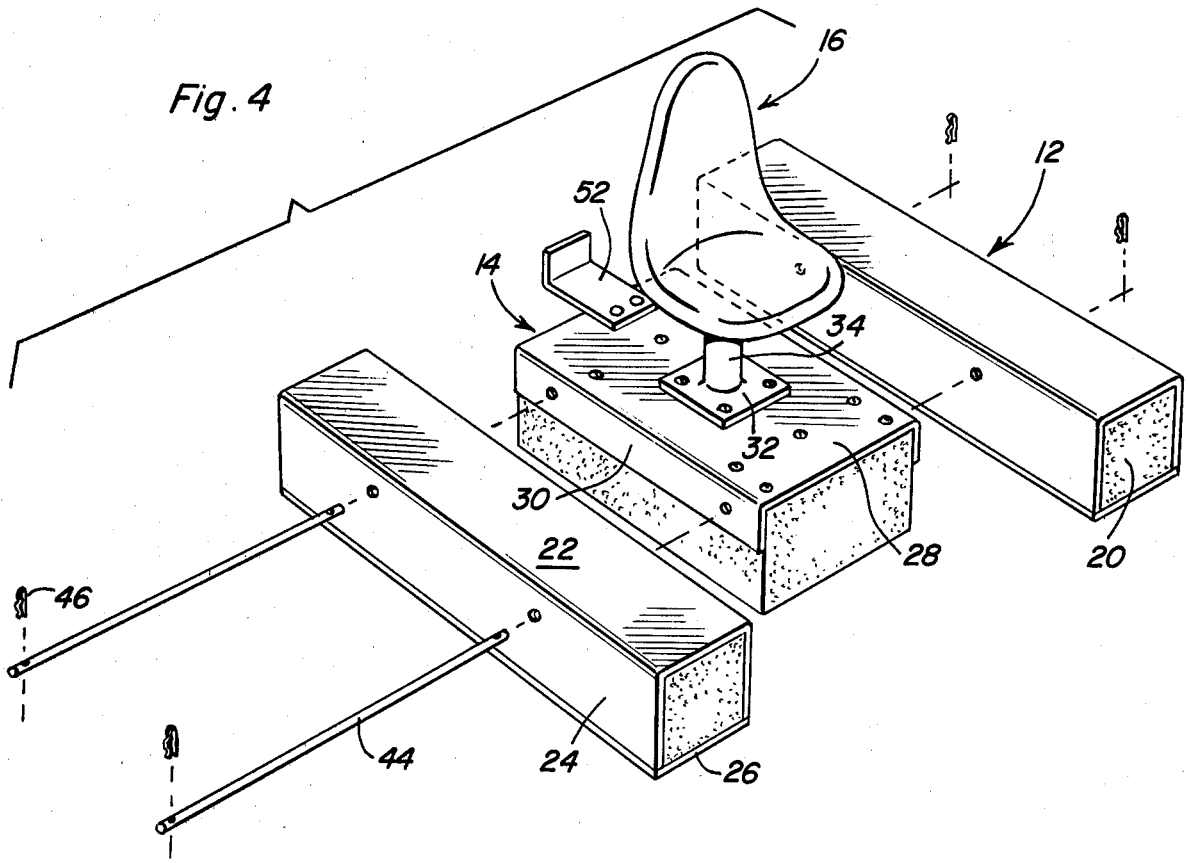
FIG. 4 is a perspective view illustrating the basic components of the pontoon boat disassembled from each other.
Figure 2:
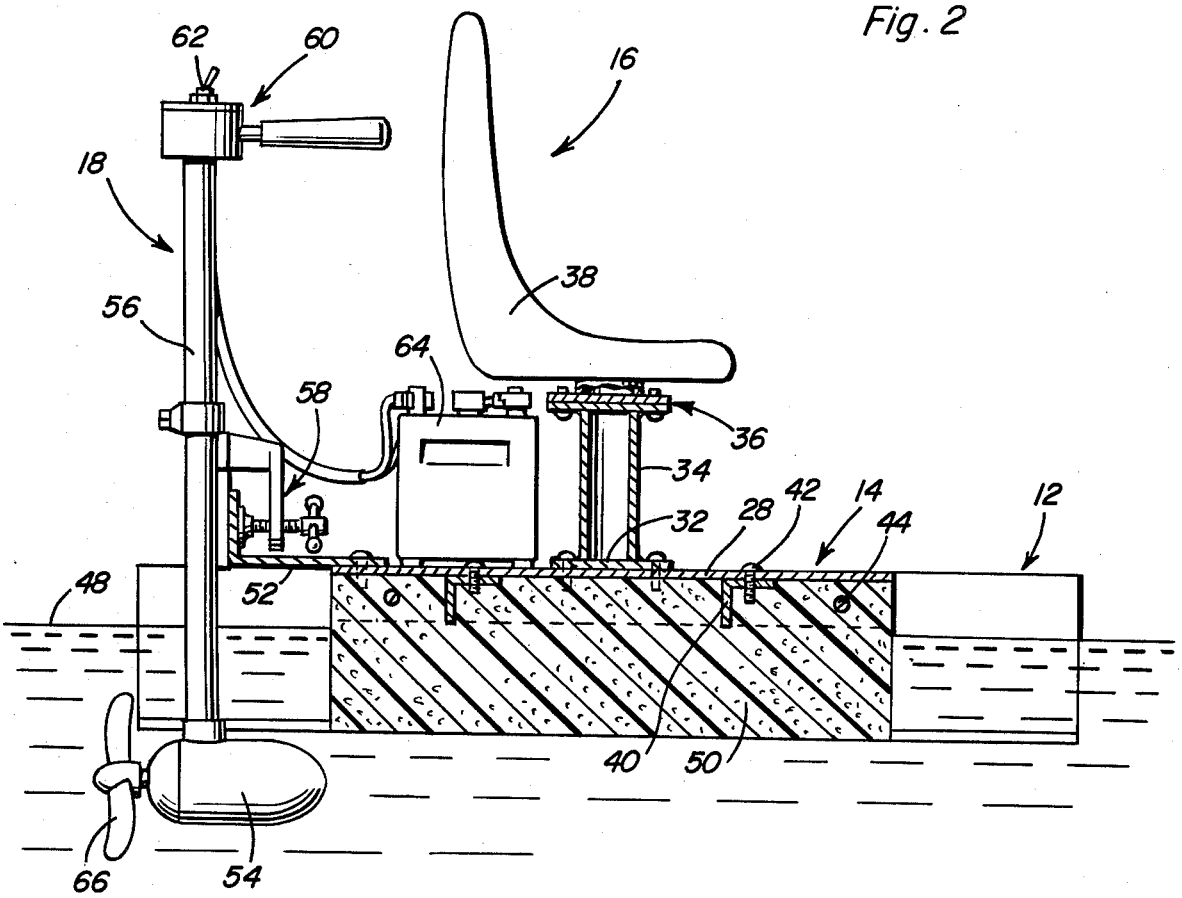
FIG. 2 is a side sectional view taken substantially through a plane indicated by a section line 2—2 in FIG. 1.

Referring now to the drawings in detail, FIG. 1 illustrates a pontoon boat constructed in accordance with the present invention and generally referred to by reference numeral 10. The boat 10 is assembled from three basic components as more clearly seen in FIG. 4, consisting of a pair of parallel spaced pontoons generally referred to by reference numeral 12. An occupant supporting seat assembly generally referred to by reference numeral 16 is mounted on the platform. A boat propelling and steering assembly generally referred to by reference numeral 18 is secured to the platform between the pontoons and rearwardly of the seat assembly 16 as shown in FIGS. 1 and 2.

Each of the pontoons 12 includes an elongated flotation body 20 made of a suitable material such as "Styrofoam." The flotation body is generally rectangular in cross-section and is enclosed by a rigid housing in the form of a member made of aluminum, for example, having an inverted, channel-shaped cross section. The aluminum housing includes a top web portion 22 and a pair of depending, parallel spaced flange portions 24. The bottom of the flotation body 20 is protectively shielded by a aluminum cover 26.

The platform 14 is also made of a relatively rigid sheet metal material such as aluminum, somewhat thicker than the aluminum from which the housings for the pontoons 12 are made. The platform also has a generally channel-shaped cross section including a top supporting web surface 28 and a pair of depending side flanges 30. The seat assembly 16 is secured to the top surface 28 of the platform by means of mounting a base 32 from which a support post 34 extends upwardly. A swivel coupling 36 interconnects the post 34 with the seat 38 which may be made of a fiber glass material. Accordingly, the seat may be rotated about a vertical axis through the post 34, by 360°. The supporting platform is rigidified by a pair of aluminum angle bars 40 that are attached to the underside by means of fasteners 42 as more clearly seen in FIG. 2. The bars 40 extend transversely between the side flanges 30 of the platform.

Figure 3:
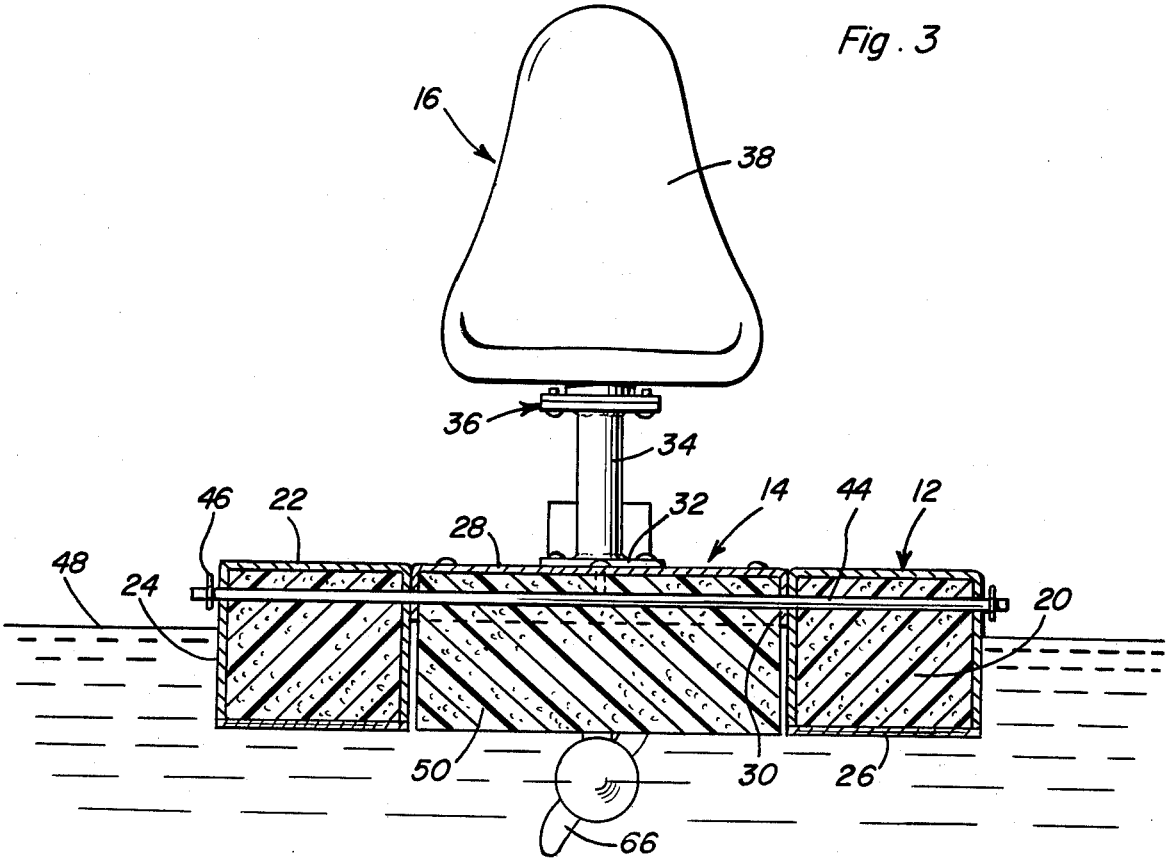
FIG. 3 is a transverse sectional view taken substantially through a plane indicated by a section line 3—3 in FIG. 1.

When assembled, the pontoons abut the side flanges 30 of the platform with the top surfaces 22 and 28 flush or coplanar. The pontoons are held assembled with the platform by means of a pair of assembly rods 44, which extend through the pontoon housings and the side flanges 30 as more clearly seen in FIG. 3. Releasable cotter pins 46 extend through apertures adjacent opposite axial ends of the assembly rods 44 in order to hold the components assembled. The assembly rods 44 maintain the top surface of the pontoons and the platform flush with each other and are located closely spaced therebelow above the waterline 48. Additional flotation may be provided for the boat by securing a flotation body 50 to the underside of the platform 14. Accordingly, the flotation body 50 will embed therein the assembly rods 44 as well as the reinforcing bars 40 as more clearly seen in FIG. 2.

The pontoons 12 are longer in the longitudinal direction than the platform 14. Secured to one end of the platform 14 and projecting rearwardly therefrom is a bracket 52. The boat propelling and steering assembly 18 may be secured to the bracket 52 as shown in FIGS. 1 and 2. The propelling and steering assembly may be a conventional unit well known to persons skilled in the art which includes a trolling type electrical motor 54 mounted at a lower end of a post 56 secured to the bracket 52 by means of a releasable clamp device 58. A steering mechanism 60 is secured to the upper end of the post 56 which also mounts a power switch 62, by means of which motor 54 is energized from a battery 64 carried on the platform 14 below the seat 38. When energized, the motor 54 drives a boat propeller 66.

It will be apparent from the foregoing description that the pontoons 12 and platform 14 may be readily disassembled for transport in the trunk of an automobile. Further, in view of the construction of the pontoons and platform from light weight aluminum and flotation material, portability in enhanced. The particular constructional arrangement and assembly of components is such as to provide the requisite rigidity for the boat when assembled and sufficient strength to resist expected loads.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A knock-down pontoon boat, comprising a pair of parallel spaced pontoons, each of said pontoons having an elongated body of flotation material and a rigid housing enclosing the flotation material, a platform member having depending side flanges abutting said housings of the pontoons, at least two assembly rods extending transversely through the housings of the pontoons and the side flanges of the platform and releasable means on the assembly rods for holding the pontoons assembled spaced from each other by the platform member.

2. The pontoon boat as defined in claim 1 wherein said pontoon housings and the platform member have top surfaces maintained in coplanar relation to each other by the assembly rods.

3. The pontoon boat as defined in claim 2 wherein said pontoon housings and the platform member are made of aluminum, the aluminum forming the platform member being thicker than the aluminum forming the housings.

4. The pontoon boat as defined in claim 3 including a seat and means mounting the seat on the platform member for rotation about a vertical axis.

5. The pontoon boat as defined in claim 4 wherein the housings and the platform member are channel-shaped in cross section.

6. The pontoon boat as defined in claim 5 including spaced reinforcing bars secured to the underside of the platform member extending between the side flanges.

7. The pontoon boat as defined in claim 1 wherein the housings and the platform member are channel-shaped in cross section.

8. The pontoon boat as defined in claim 1 wherein said pontoon housings and the platform member are made of aluminum, the aluminum forming the platform member being thicker than the aluminum forming the housings.

* * * * *